United States Patent [19]

Kelley

[11] Patent Number: 4,941,654

[45] Date of Patent: Jul. 17, 1990

[54] METHOD AND APPARATUS FOR STACKING APERTURED SHEETS WITHOUT JAMMING

[75] Inventor: Gary L. Kelley, Milford, Mass.

[73] Assignee: Dennison Manufacturing Company, Framingham, Mass.

[21] Appl. No.: 760,010

[22] Filed: Jun. 29, 1985

[51] Int. Cl.[5] ..... B65H 31/00

[52] U.S. Cl. ..... 271/209; 271/215; 271/219

[58] Field of Search ..... 271/209, 219, 161, 215

[56] References Cited

U.S. PATENT DOCUMENTS

| | | | |
|---|---|---|---|
| 1,210,465 | 1/1917 | Gubelman | 271/209 |
| 1,490,070 | 4/1924 | Korth | 271/161 |
| 1,694,638 | 12/1928 | Borrowdale | 271/219 |
| 3,720,407 | 3/1973 | Woodward | 271/161 |
| 3,761,080 | 9/1973 | Larson | 271/209 |
| 3,793,950 | 2/1974 | Kaneko et al. | 271/209 |
| 4,400,124 | 8/1983 | Greller | 271/209 |

*Primary Examiner*—H. Grant Skaggs

*Attorney, Agent, or Firm*—George E. Kersey

[57] ABSTRACT

An elongated arch forming member or bar supported upon a horizontal stacking station base by a movable support for permitting the stack to be lowered as the weight of the of sheets over the arch forming member increases. The arch forming member supports the sheets only at centralized portions thereof for permitting edge portions of the sheets to be pulled downwardly by gravity to form an arch, in the stack of sheets, transverse to the direction of feed of the sheets from a printer or source machine into a receptor station. The arch forming member is oriented parallel to opposite edges of the sheets and causes an angle of at least 15° to be produced between the edge portions of the sheets and the horizontal plane of the base.

6 Claims, 2 Drawing Sheets

FIG. 2A
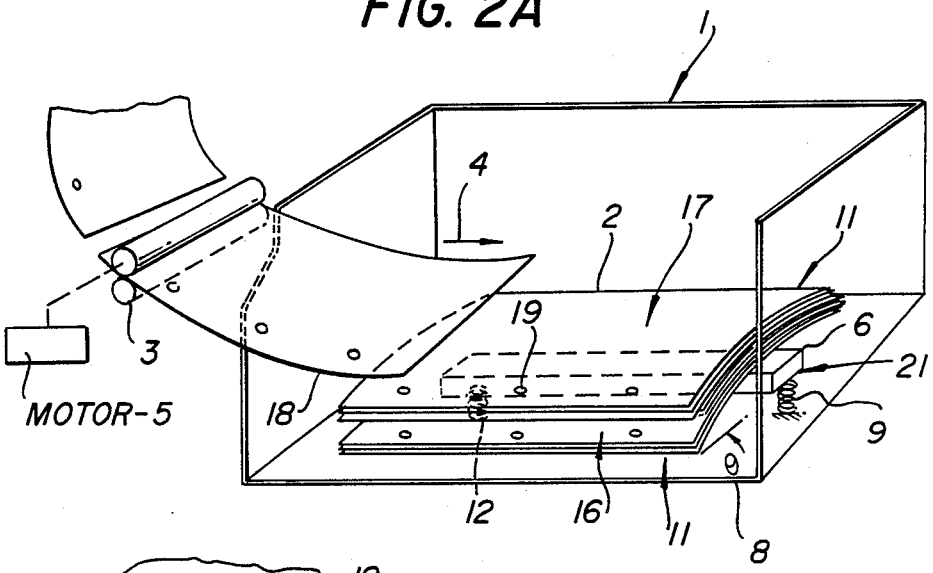
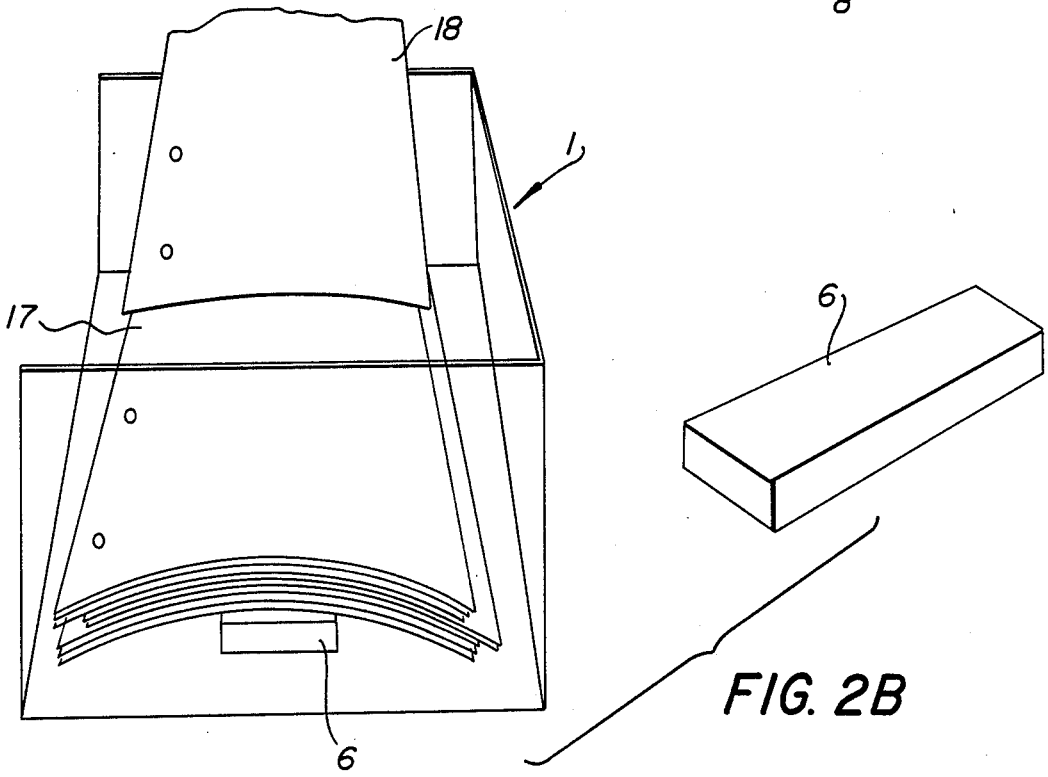
FIG. 2B

METHOD AND APPARATUS FOR STACKING APERTURED SHEETS WITHOUT JAMMING

BACKGROUND OF THE INVENTION

The present invention relates to the stacking of sheets.

After images are formed upon sheets being processed through electronic printers or other copy machines they are sequentially fed to a sheet stacking station in a given direction. It has been found that there is interference with the orderly stacking of such sheets by various factors. One factor is that the corner of a sheet being directed into the stacker catches or snags with respect to an aperture, such as a punched hole, formed within a sheet in the stack previously fed to the sheet receptor or stacking station. It also has been observed that generally there is a tendency for sheets to stick together. The result of these phenomenon is that jamming or disorderly stacking of the sheets may result.

Accordingly it is an object of the present invention to provide a stacking method and apparatus that eliminates undesirable effects.

It is a further object of the present invention to eliminate undesirable effects in a manner simple and economical, which does not involve complex devices or methods for manipulating the sheets.

SUMMARY OF THE INVENTION

In accordance with the present invention, an elongated arch forming member or bar is supported upon a horizontal stacking station base by a movable support for permitting the stack to be lowered as the weight of the stack of sheets over the arch forming member increases. The arch forming member supports the sheets only at centralized portions thereof for permitting edge portions of the sheets to be pulled downwardly by gravity to form an arch in the stack of sheets. The arch is transverse to the direction of feed of the sheets from the printer or source machine into the receptor station. The arch forming member is oriented parallel to a pair of edges of the sheets and causes an angle of at least 15° to be produced between the edge portions of the sheets and the horizontal plane of the base.

DESCRIPTION OF THE DRAWINGS

Other objects, features and advantages of the present invention will become apparent upon consideration of a specific description, taken in conjunction with the Figures in which:

FIGS. 2A and 2B are perspective views of enlarged parts of FIG. 1 showing details of the invention.

SPECIFIC DESCRIPTION

Figure 1:
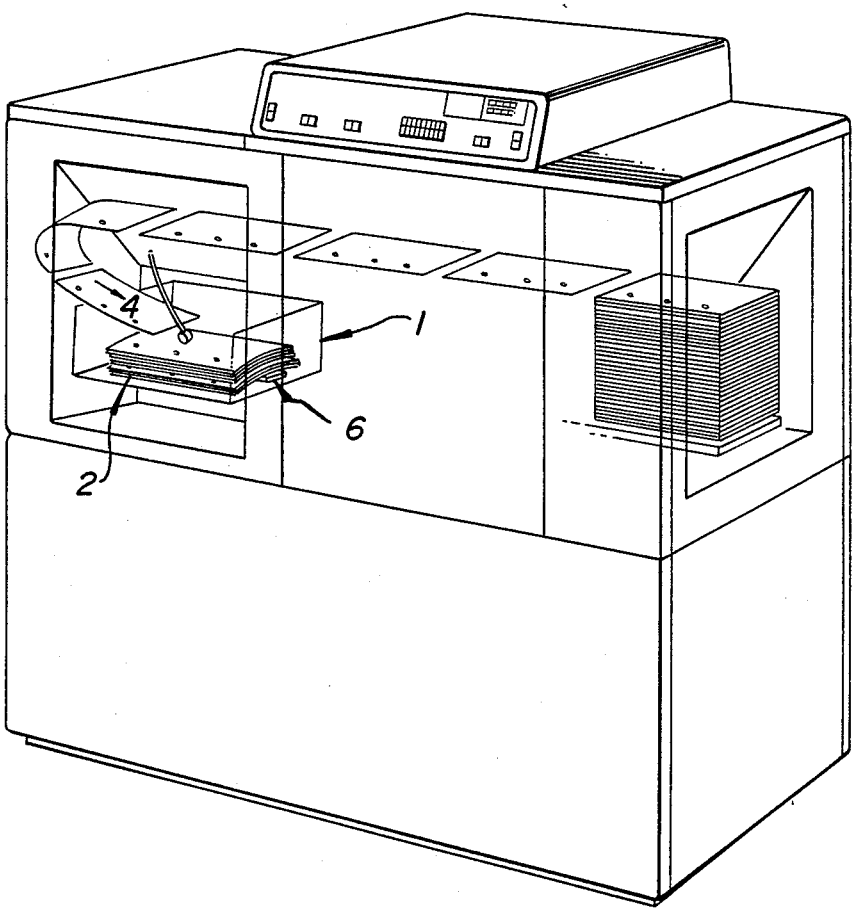
FIG. 1 is a printer employing the invention.

Referring now to the Figures, a sheet receptor station 1 is schematically illustrated for receiving an accumulating stack of sheets 2. Sheet feed means 3, schematically illustrated as a roller pair driven by motor 5 drives the sheets in a general direction toward the receptor station as indicated by arrow 4. An arch forming means comprises an elongated support member which could be merely a metallic bar 6, such bar being movably supported upon base 8 by springs 9 and 12. The length of the arch forming means or elongated bar 6 may be seen to be parallel to the edges 11 of the stacked sheets and parallel to the direction of feed indicated by arrow 4. The width of the bar in the direction perpendicular to the direction of feed however is only a minor fraction of the width of the sheets perpendicular to the elongated edges 11, and as a result, the non-centralized sheet portions 16 and 17 are permitted to be pulled downwardly owing to the action of gravity as illustrated.

In the absence of the novel arch-forming structure of the invention, the sheets would lie flat, and thus it may be seen that the corner portions of the paper such as for example, corner 18 could catch or be snagged by aperture 19, and curling of the sheet and jamming of the paper within the station 1 could occur. The width or end dimension 21 of the arch former is a fraction of the width of the paper to provide this effect, and it is preferred that the width of the arch former be narrow enough so that an angle of at least 15° is produced between the edge portions 16 and 17 of the paper and the horizontal plane of base 8, this angle theta being illustrated in FIG. 2A.

It may also be observed that the area of contact between the uppermost bowed sheet in the stack, and the lower surface of the sheet being fed is thus reduced owing to the bowing and thus any deleterious effect of electro-static charges, causing the top sheet being fed to stick to the upper sheet of the stack, is reduced. The upper surface of the arch forming means 6 could of course have a curvature complimentary to the curvature of the stack if desired.

As the weight of the stack increases due to a build up of accumulated sheets within receptor station 1, the stack is lowered owing to the increased weight of the stack asserted against the springs 9 and 12, and as a result, the top sheet of the stack will be in the same approximate vertical position as the top sheet before the stack is created. This arrangement is preferred, since it is undesirable for the position of the top sheet to rise. Such action would increase the possibility of jamming due, for example, to the snagging of corner 18 by aperture 19. In effect, the position of aperture 19 is maintained well away from the position of the incoming corner 18 of the sheet being fed into the receptor station. By the time the incoming sheet settles over the stack due to the drooping effect of gravity (upon the unsupported sheet edge portions 16 and 17), the sheet will no longer be transported in a forward direction to cause such snagging or other jamming to occur.

The above described invention is incorporated in an electronic printer. In this printer a roller arm, represented schematically by reference A in FIG. 1, moves transversely from side to side across the width of the sheets being stacked to sort them into individually stacked groups of paper. While such a conventional device forms no part of the present invention, the width 21 of the arch former 6, should be at least as wide as the total traverse of the roller arm so as not to interfer with the smooth distribution of the sheets into separate groups.

It should be understood that the present invention is not to be limited by the specific description set forth above, and the scope of the invention is to be limited only by the terms of the following claims, and equivalents thereof. For example, the arch forming means could comprise means for directing air used for cooling the printer under pressure at the underside of the central portions of the stack, although the simple support member 6 is greatly preferred. Furthermore, the stack need not be horizontally oriented, and air streams could be directed at centralized portions of one side of a nonhorizontally oriented stack and/or at edge portions of the other side of the stack. The sheet feeding means could comprise vacuum sucker bars rather than a roller pair. Support member 6 could comprise a plurality of discrete support elements rather than the unitary elongated block illustrated. Also the given direction of feed of the sheets could vary somewhat from sheet to sheet, and thus not need be fixed or predetermined.

I claim:

1. A sheet stacker comprising:

a. a sheet receptor station for accumulating a stack of sheets;

b. sheet feed means for feeding each sheet in a given feed direction toward said stacking station, said stacking station further including a base;

c. arch forming means for supporting said stack only at a plurality of centralized portions thereof for permitting edge portions thereof to be pulled downwardly toward said base by gravity to form an arch in said stack transverse to said direction of feed, together with movable sheet support means, coupled between said base and said arch forming means, for permitting said sheets to be lowered toward said base as the weight of the stack of sheets over said arch forming means increases.

2. The combination as set forth in claim 1 wherein said arch forming means is configured to produce an angle of at least 15° between the surfaces of said edge portions of said sheets and the horizontal.

3. The combination as set forth in claim 2 wherein said arch forming means comprises support means for contacting the underside of said stack.

4. The combination as set forth in claim 3 wherein said support means comprises an elongated unitary support member having the major dimension thereof oriented substantially parallel to a pair of edges of such sheets.

5. The combination as set forth in claim 3 wherein said arch forming means forms said arch perpendicular to said feed direction.

6. The combination as set forth in claim 2 wherein said arch forming means forms said arch perpendicular to said feed direction.

* * * * *